United States Patent [19]

Fukuda et al.

[11] Patent Number: 4,852,696

[45] Date of Patent: Aug. 1, 1989

[54] INFORMATION DEVICE OF ELEVATOR

[75] Inventors: Toshio Fukuda; Kenji Yoneda; Takaaki Ueshima; Osamu Sasaki, all of Katsuta, Japan

[73] Assignee: Hitachi Ltd., Tokyo, Japan

[21] Appl. No.: 159,221

[22] Filed: Feb. 23, 1988

[30] Foreign Application Priority Data

Feb. 28, 1987 [JP] Japan ..... 62-45652

[51] Int. Cl.[4] ..... B66B 3/00

[52] U.S. Cl. ..... 187/139

[58] Field of Search ..... 187/130, 132, 133, 135, 187/138, 139

[56] References Cited

U.S. PATENT DOCUMENTS 4,577,177 3/1986 Marubashi ..... 187/139

4,749,062 6/1988 Tsuji et al. ..... 187/139

*Primary Examiner*—William M. Shoop, Jr.

*Assistant Examiner*—W. E. Duncanson, Jr.

*Attorney, Agent, or Firm*—Antonelli, Terry & Wands

[57] ABSTRACT

An elevator information device is disclosed. The elevator information device has displays located in each hall of a building, each of which can display the service state of the elevator (information on arrival of a car, number of passengers in the car, floors at which the car is about to stop, waiting time, position of the car) by means of pictures and characters, whereby waiting passengers can easily understand the condition of the elevator. As a result, the waiting passengers do not feed uncomfortable due to confusion, impatience or distrustfulness. Consequently, the waiting passengers can be guided smoothly.

7 Claims, 9 Drawing Sheets

| | PATTERN NO. | PARAMETER 1 | PARAMETER 2 | ------ | PARAMETER m |
|---|---|---|---|---|---|
| FIRST FLOOR | P(1) | | | | |
| SECOND FLOOR | P(2) | | | | |
| ⋮ | | | | | |
| (n-1)-TH FLOOR | P(n-1) | | | | |
| (n)-TH FLOOR | P(n) | | | | |

INFORMATION DEVICE OF ELEVATOR

BACKGROUND OF THE INVENTION

This invention relates to an information device of an elevator, and more particularly to an information device of a group-controlled elevator system which has display devices that are suitable for informing waiting passengers and giving them information.

Such a device in the prior art is disclosed in Japanese Patent Laid-Open No. 92880/1984, wherein a camera is provided in a car for the purpose of displaying to waiting passengers at each floor a picture obtained by the camera to show the degree of crowding in the car, in addition to information such as the position of the car and previously registered car-calling floor numbers when the car reaches or is to reach each floor.

Another type is disclosed in Japanese Patent Publication No. 43989/1981, wherein the position of the car of the elevator is displayed at the floor where the car is about to arrive.

However, in the prior art, the device in which a camera is provided needs a camera, so its cost becomes high. Furthermore, a problem regarding the privacy of passengers is raised because the passengers in the car are filmed. On the other hand, the device in which the position of the car is displayed at the floor where the car is about to arrive is not very expensive. However, if a reserved car moves away from the floor at which the passengers are waiting, the waiting passengers will not trust the device. Neither of the prior-art devices described above can give the waiting passengers clear information relevant to the service conditions.

An object of the present invention is to provide an information device of an elevator which can display the service conditions of the elevator to waiting passengers in such a manner that they can easily understand them without becoming confused, impatient, or distrustful.

SUMMARY OF THE INVENTION

The above object is achieved, as the first characteristic of this invention, by providing service information devices which are disposed at each boarding place; evaluation value arithmetic means for obtaining an evaluation value from the state of the elevator; means for judging at least said evaluation value and determining a type of display pattern of the service information device; and processing means for generating picture data of the service information device in accordance with information showing the state of the elevator and the thus-determined type of display pattern. As a result, service conditions of the elevator (such as arrival information, the state in the car, the floors at which it will stop, the waiting time, the position of the car) and a message corresponding to the conditions of the elevator are displayed by the service information device (display), using pictures and characters.

Furthermore, the above object is achieved, as the second characteristic of this invention, by providing means for judging the fact whether the evaluation value satisfies predetermined conditions (generated when an automatic operation mode is detected, when a controlled operation mode is detected, when a hall call at the relevant floor is detected, when a car is detected at a location within a predetermined number of floors of and upstream of the floor making a hall call, when the waiting time is shorter than a predetermined time) and determining whether a display pattern displayed by the service information device is operation information on the elevator (number of passengers in a car, the position of the car, reserved floor at which the car is about to stop, relevant floor mark, the direction of travel of the car) or general information (building information, time information, weather report) other than the operating information, and means for generating picture data.

Since information relevant to the service conditions of a car of the elevator can be provided for waiting passengers, floor reservation and similar information can be smoothly offered. As a result, the impatience and distrust which can occur when passengers have to wait for a long time can be prevented.

DESCRIPTION OF THE PREFERRED EMBODIMENTS

The present invention will now be described with reference to embodiments shown in FIGS. 1 to 7.

Figure 1:
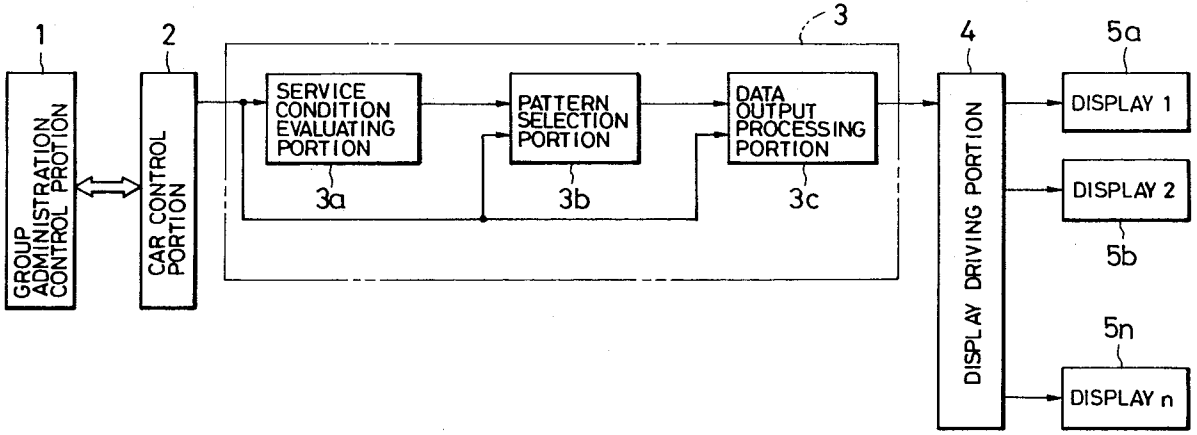
FIG. 1 shows an embodiment of an overall block diagram of an information device of an elevator according to the present invention.
Figure 2:
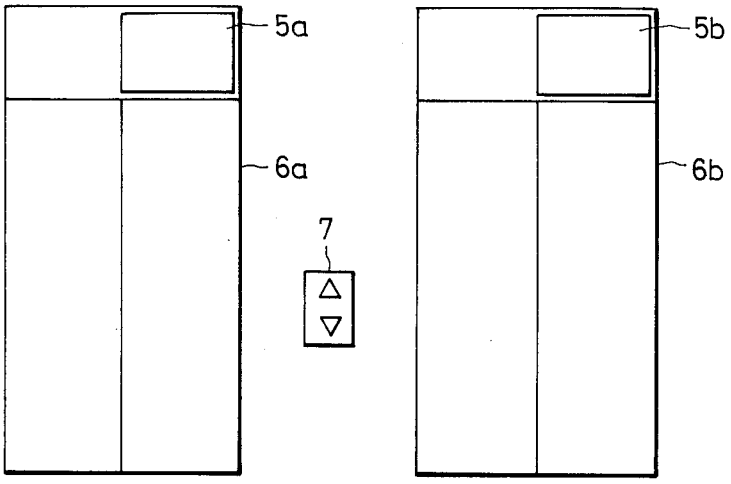
FIG. 2 shows the positions of the displays.

FIG. 1 is an overall block diagram of an embodiment of an information device of an elevator according to the present invention. FIG. 2 illustrates the positions at which displays are disposed. Although FIG. 2 shows displays 5*a* and 5*b* are disposed above doors 6*a* and 6*b* at each floor, they may of course be disposed beside the doors 6*a* and 6*b* or be integrally formed with the doors 6*a* and 6*b*. In a group-controlled elevator system, one display may be provided for the group of cars. Reference numeral 7 represents a hall calling registration device.

The structure shown in FIG. 1 will now be summarized. The structure comprises in main a group administration and control portion 1, a car control portion 2, a data processing portion 3 for the displays, a display driving portion 4, and displays 5*a* to 5*n*.

The data processing portion 3 for the displays comprises a service condition evaluating portion 3*a*, a pattern selection portion 3*b*, and a data output processing portion 3*c*.

The service condition evaluating portion 3*a* evaluates signals supplied from the car control portion 2 indicating the conditions of the elevator (such as the position of the car, the car calling floors, the assigned hall calling floor, and the number of passengers in the car) and outputs the result as a service condition flag to the pattern selection portion 3*b*. The pattern selection portion 3*b* selects the most suitable type of display pattern to be displayed by the displays 5*a* to 5*n*, based upon the signal indicating the conditions of the elevator and the service condition flag supplied from the service condition evaluating portion 3*a*. The pattern selection portion 3*b* outputs the selected type of pattern to the data output processing portion 3*c*. The data output processing portion 3*c* generates the selected type of display pattern obtained from the pattern selection portion 3*b* and the signals indicating the conditions of the elevator, and outputs the generated signal to the display driving portion 4.

The display driving portion 4 generates picture data, using data supplied from the data output processing portion 3*c*, and outputs it to the displays 5*a* to 5*n*.

The displays 5*a* to 5*n* are, as described above, disposed in the hall on each floor or in predetermined halls, and display pictures using picture data from the display driving portion 4. Liquid-crystal displays, CRTs, or the like are employed as the displays 5*a* to 5*n*.

Figure 3:
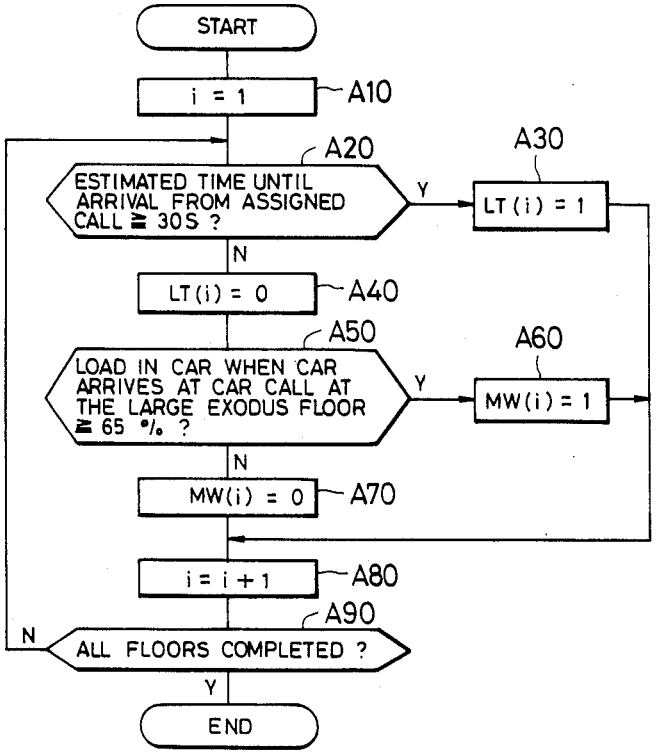
FIG. 3 shows an embodiment of a flowchart of a processing program in a service condition evaluating portion shown in FIG. 1.

FIG. 3 is a flowchart illustrating an embodiment of a processing program in the service condition evaluating portion 3*a*. This program is periodically actuated, for example, every second, and evaluates the service conditions for hall calls, and outputs the result of the evaluation as service condition flags {LT(i), MW(i)}.

First, a variable i for each floor being processed is initialized in step A10, and the subsequent processes are looped for each of the floors. In step A20, the system determines whether the estimated arrival time exceeds 30 seconds after the car calling has been made. If the answer is YES, the state is determined to be a long wait, and the flow moves to step A30 in which 1 is set in a long wait flag LT(i). If the determination of step A20 gives the answer NO, the flow moves to step A40 in which the long wait flag is cleared. Then, in step A50, the system determines to stop the car at a floor at which a large number of passengers are to get off (large exodus floor), from the calls from the car and whether the load in the car exceeds 65%. If answer is YES, the state is evaluated as a large exodus, and the flow moves to step A60 in which 1 is set in the large exodus flag MW(i). If the determination in step A50 gives the answer NO, the flow moves to step A70 in which the large exodus flag is cleared.

Table 1 shows the relationships between the pattern selection conditions selected by the pattern selection portion 3*b* and the details to be displayed. The pattern selection portion 3*b* selects the type of pattern in accordance with the conditions shown in Table 1, and determines the display according to the selected type of pattern and the conditions (displayed details) of the elevator. For example, if the elevator is in a special operation mode, the display pattern becomes 1, whereby the displayed details are formed by the operation mode and a message relating to that mode. An example of this is shown in FIG. 7(*a*).

Figure 4:
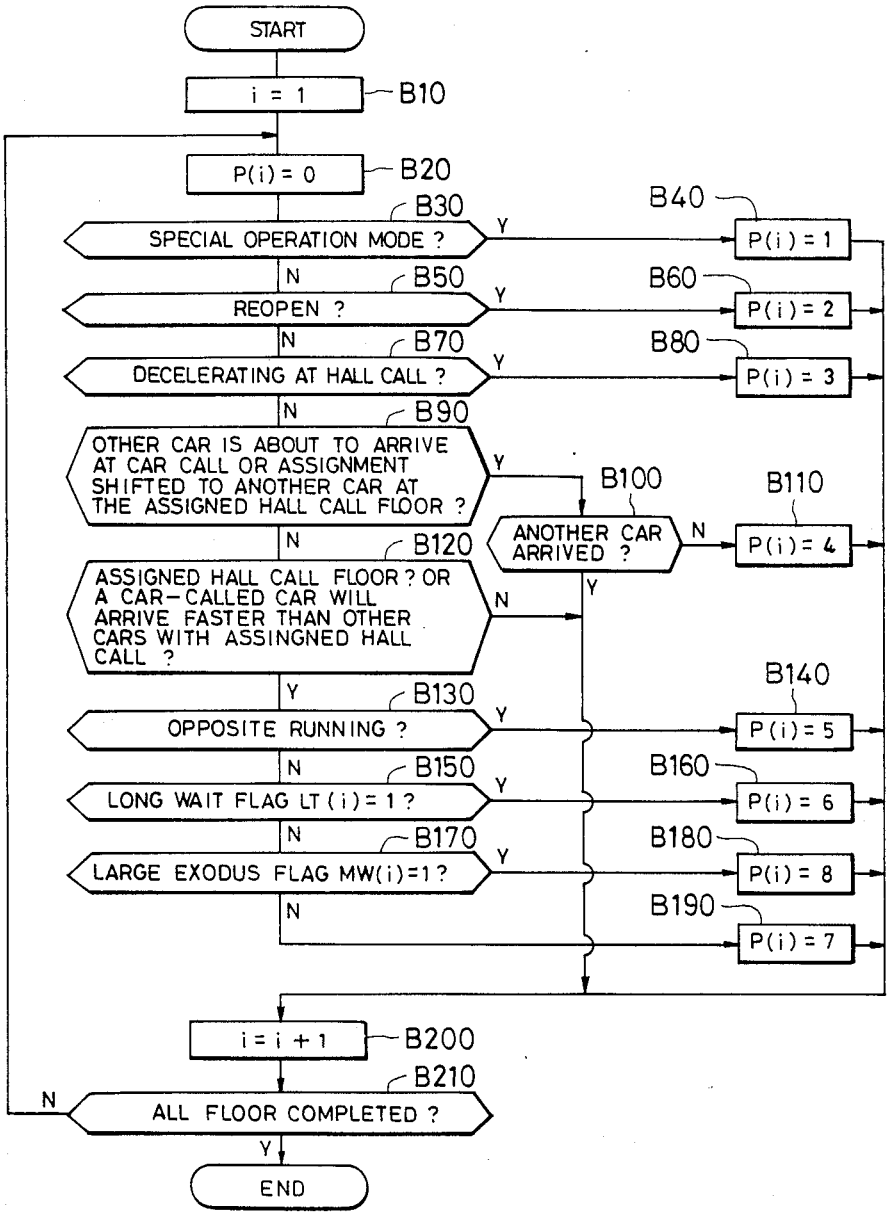
FIG. 4 shows an embodiment of a flowchart of a processing program in a pattern selection portion shown in FIG. 1.

FIG. 4 is a flowchart of an example of a processing program in the pattern selection portion 3*b*. The contents of this drawing are a realization of the details given in Table 1, but in which the processing of display patterns 9 and 10 of Table 1 are omitted.

TABLE 1

| Pattern | Condition | Details of display | FIGURE |
|---|---|---|---|
| 0 | Not applied to any of the following conditions | No display | — |
| 1 | Special operation mode (manual, exclusive, maintenance, administration, operation control) | Details of the operation mode | 7-(a) |
| 2 | Reopen | Time until door closes | 7-(b) |
| 3 | Arriving at a decelerated speed at a hall calling floor | Operating direction (flicker) | 7-(c) |
| 4 | Reassign to another car or other car will arrive earlier at a car call | Reassignment or car No. which arrives earlier and its direction (flicker) | 7-(d) |
| 5 | Assignment received but operating in the opposite direction | Position of the car, operating direction, and door open or closed condition | 7-(e) |
| 6 | Long wait flag LT = 1 | Position of the car, operating direction, car stopping floors (car call, hall call), door open and closed state, mean wait time | 7-(f) |
| 7 | Car is about to arrive earlier by a hall call assignment of car call | Position of car, operating direction, door open and closed state | 7-(g) |
| 8 | Large exodus flag WT = 1 | | 7-(h) |
| 9 | Building information required | Building information | — |
| 10 | Two or more cars wait at one floor | Order of starting | — |

First in step B10, the variable i for processed floors is initialized.

The following processe are looped for each of the floors. In step B20, 0 is set in the variable of the display pattern No. P(i). Then, in step B30, whether the system is in a special operation mode is determined. If the answer is YES, the flow moves to step B40 in which P(i) is set to 1. If the answer is NO, the flow moves to the next step B50. In step B50, whether the system is in a reopen process is determined. If the answer is YES, the flow moves to step B60 in which P(i) is set to 0. If the answer is NO, the flow moves to the next step B70. In step B70, whether the car speed is decelerating to the floor in which a hall call is made is determined. If the answer is YES, the flow moves to step B80 in which P(i) is set to 3. If the answer is NO, the flow moves to the next step B90. In step B90, whether an assigned hall call is made and another car is about to arrive earlier at a car call or the assignment is changed to another car is determined. If the answer is YES, the flow moves to step B100 in which whether the other car has arrived is determined. If the answer is NO, the flow moves to step B110 in which P(i) is set to 4. If the answer is YES, the flow moves to the process for the next floor. If the answer is NO in step B90, the flow moves to the next step B120 in which whether the assigned hall call is available or whether a car-called car is about to arrive earlier than the other car which has the assigned hall call is determined. If the answer is NO, the flow moves to the process for the next floor. If the answer is YES, the flow moves to step B130 in which whether the car is running in the opposite direction from the processed floor is determined. If the answer is YES, the flow moves to step B140 in which P(i) is set to 5. If the answer is NO, the flow moves to the next step B150. In step B150, whether it is long wait flag LT(i)=1 is determined. If the answer is YES, the flow moves to step B160 in which P(i) is set to 6. If the answer is NO, the flow moves to the next step B170. In step B170, whether it is large exodus flag MW(i)=1 is determined. If the answer is YES, the flow moves to step B180 in which P(i) is set to 8. If the answer is NO, the flow moves to step B190 in which P(i) is set to 7, and moves to the process for the next floor.

Figures 5, 6:
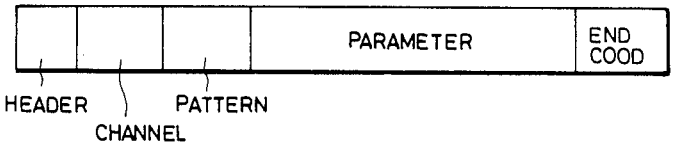
FIG. 5 shows an example of output data which has been generated in the data output processing portion shown in FIG. 1.
FIG. 6 shows another example of the output data which has been generated in the data output processing portion shown in FIG. 1.
Figure 7A:
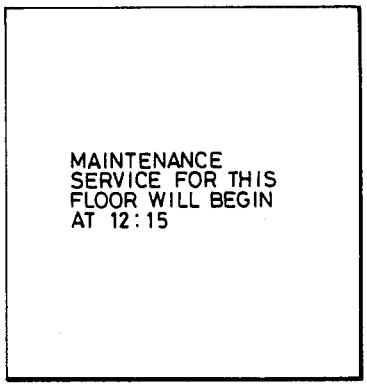
FIGS. 7*a–h* show an embodiments of display patterns.
Figure 7B:
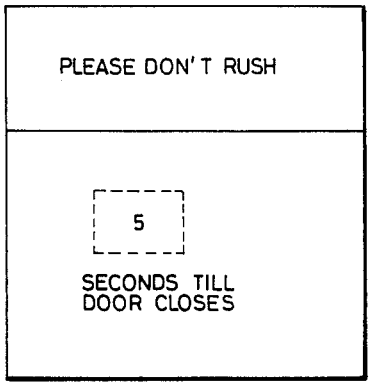
Figure 7C:
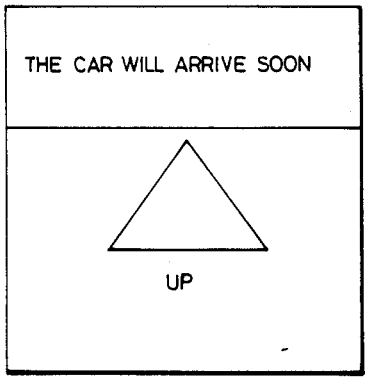
Figure 7D:
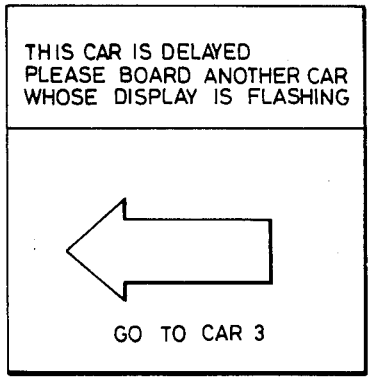
Figure 7E:
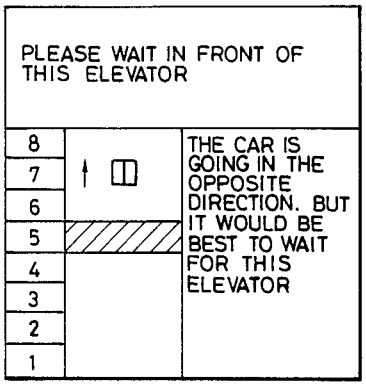
Figure 7F:
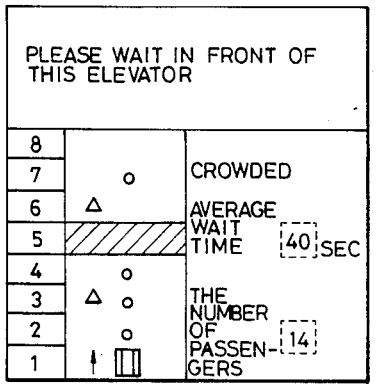
Figure 7G:
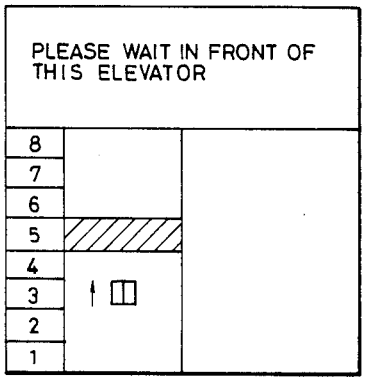
Figure 7H:
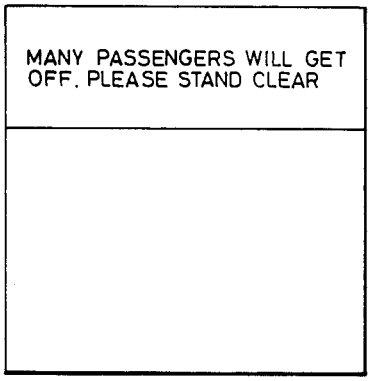

FIG. 5 illustrates an example of output data which is generated in the data output processing portion 3c shown in FIG. 1. The pattern Nos. which have been selected in the pattern selection portion 3b and parameters (elevator state signal) which are necessary for the details to be displayed are arranged for the required number of floors. The pattern Nos. and the parameters are sent periodically to the display driving portion 4 shown in FIG. 1.

FIG. 6 illustrates another example of output data generated in the data output processing portion 3c, in which channels show the floor to which data is applied.

FIG. 7 illustrates an embodiment of the display patterns, and the detail will now be described.

FIG. 7(*a*) shows that the elevator system is in a maintenance state and the operation starting time is also shown. FIG. 7(*b*) shows a message when the door is opened at a hall call and the time until the door will be closed. FIG. 7(*c*) shows a message when the car is to arrive and the operating direction. FIG. 7(*d*) shows the direction of the car and car No. and a message in order to inform the waiting passengers when hall call is reassigned to another car or another car arrives earlier at a car call. FIG. 7(*e*) shows a message so as to make passengers feel easy when the car is moving away from the floor at which the waiting passengers exist when the call is assigned. FIG. 7(*f*) shows the floors at which the car will stop, a mean wait time, and the number of passengers in the car when a long wait is expected for the purpose of preventing the waiting passengers from getting tired and impatience. FIG. 7(*g*) shows information on a certain car when a hall call is assigned or a car is about to arrive earlier at a car call, and the position of the car and the operating direction are also displayed. FIG. 7(*h*) shows a message for warning the waiting passengers when large exodus is expected.

According to the present invention, suitable messages can be displayed for the waiting passengers when the reservation is changed, a car will arrive earlier at a car call, a car moves in the opposite direction although a hall call is assigned. As a result of this, the waiting passengers can be prevented from feeling untrust and impatience. Consequently, the waiting passengers can be guided smoothly.

Another embodiment of the present invention will now be described.

The pattern 9 shown on Table 1 is a mode for displaying building information classified as general information (general information such as information on an event held in the building, time information, weather reports and so forth, such information being not related to the operation of the elevator) for the convenience of passengers, the general information being displayed at all times or when a long waiting is expected.

The characteristic of this embodiment lies in the fact that such general information and operating information are alternately displayed, and that in certain circumstances operating information is given priority.

Figure 9A:
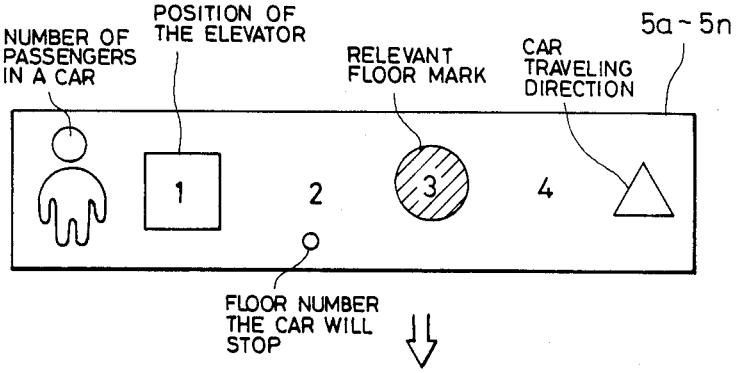
Figure 9B:
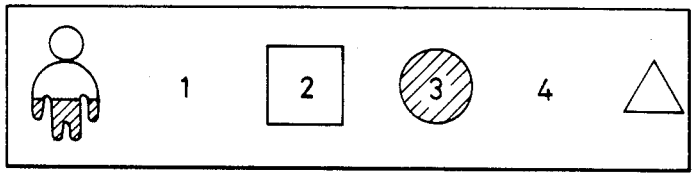
Figure 9C:
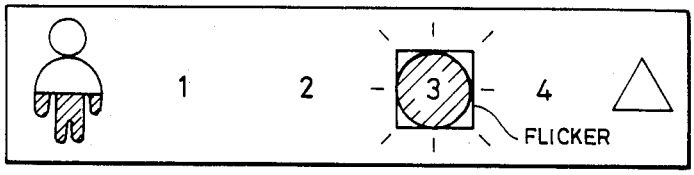

In this embodiment, operating information is arranged to be displayed in such a manner, as shown in FIG. 9, that the number of passengers in a car, the position of a car, the floor at which the car is about to stop, relevant floor mark, the direction of travel of a car are shown, instead of displaying various conditions (mainly they are messages) according to the conditions of each car, for the purpose of using common display patterns.

Figure 8A:
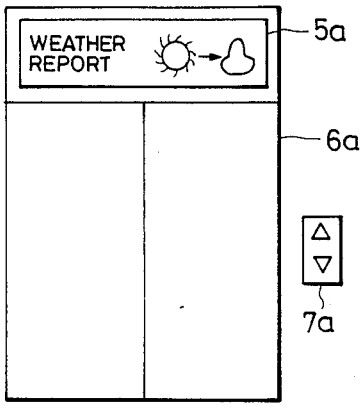
FIGS. 8*a* and *b*, 9*a–c* and 10 show examples of display patterns according to the other embodiments.
Figure 8B:
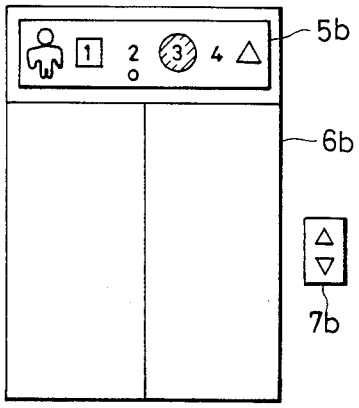

Referring to FIG. 8, display modes in this embodiment will now be described. FIG. 8 illustrates displays 5a and 5b disposed at the third floor when this invention is applied to an elevator which serves four floors. FIG. 8(*a*) illustrates a case where a weather report is selected from a plurality of information as general information to be displayed. The general information can include, in addition to the illustrated weather report, the present time, event or sales information at a given floor, train departure times in the case of a station building. None of these are regarded as being operating information on the elevator (6a, 6b, 7a, 7b are the same as those shown in FIG. 2).

FIG. 8(*b*) shows a state where the operating condition of the elevator assumes a predetermined state, for example, a state where the car is about to reach a given this floor, whereupon a display mode for displaying general information is interrupted and switched to an elevator operating information display mode.

Among the various operating information displays which can be employed, the following displays are utilized in this embodiment as shown in FIG. 9(*a*).

(i) Position of the car which is being operated (square mark)
(ii) Direction of travel of the car which is being operated (triangular mark facing upwardly or downwardly)
(iii) Floor where the car is about to stop in response to a car call or hall call (round mark)
(iv) Relevant floor mark (floor number is displayed by lighting the area rounded by a circle in a flicking manner)
(v) Number of passengers in a car (the pictorial representation of human is partially lit up)

The display of the operating conditions of the elevator changes in accordance with the operating conditions as shown in FIGS. 9(*b*) and 9(*c*).

FIG. 9(*b*) illustrates a display showing a state in which the car is stopped at the second floor and the number of passengers in the car is 50% of the limit for that car. FIG. 9(*c*) illustrates a state in which the car arrives at the third floor where the car has been called and the door of the car is opened.

The particular conditions employed in this embodiment which serve to change over the general information to information on the operating condition of the elevator, and which are chosen from the various conditions which could potentially be employed are as follows:

(i) when automatic operation mode is detected
(ii) when controlled operation mode is detected (iii) when a hall call made at this floor is detected
(iv) when a car is detected at a location within a predetermined number of floors of and upstream of a floor at which the hall call was made
(v) when waiting time at the hall is shorter than a predetermined time In addition to the conditions described above, a condition where a waiting-passenger sensor detects waiting passengers can be employed.

Figure 10:
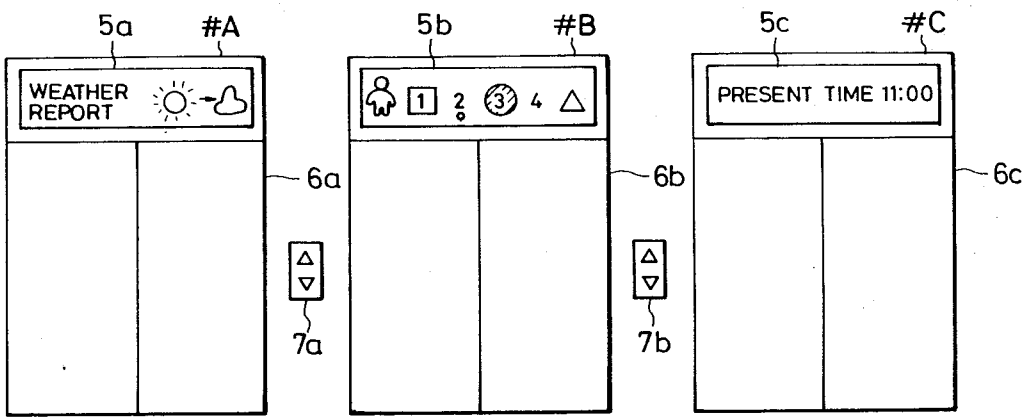

Referring to FIG. 10, an example of display patterns where this invention applies to an elevator system which serves a plurality of elevators will now be described. In this example, displays 5*a* to 5*c* for three elevators (#A, #B, #C) are provided. Each of the display devices of the elevators #A and #C show general information, while that of the elevator #B show operating information on the elevator. That is, only the assigned elevator displays the operating condition of the elevator. In this state, general information displayed in the elevators other than the assigned elevator can, of course, include information which is different for each or it may be the same general information.

Figure 11:
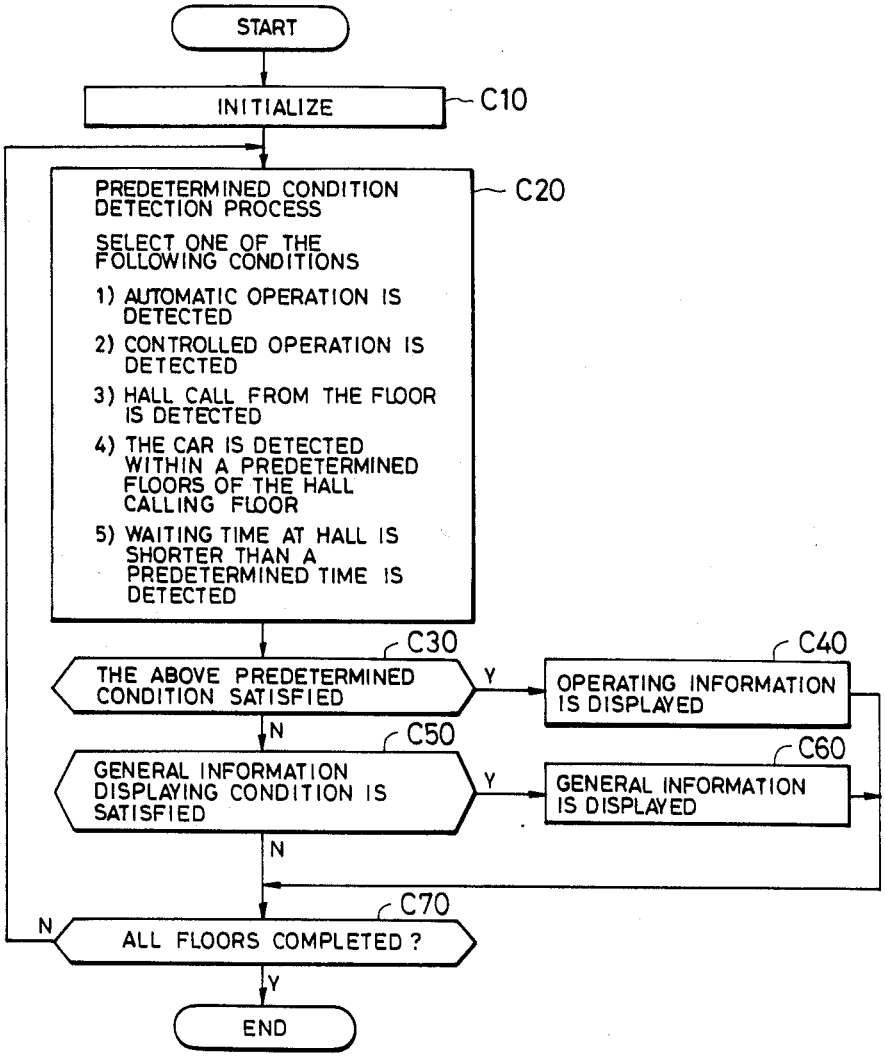
FIG. 11 shows a flowchart according to another embodiment.

Referring to FIG. 11, a flowchart according to another embodiment will now be described. This flowchart is substantially the same as that shown in FIG. 4, and the details are therefore omitted.

In step C10, initializing is performed, and in step C20, in which of five conditions the elevator is operated is detected. In step C30, whether a predetermined condition is satisfied is determined. If the answer is YES, the flow moves to step C40 in which information on the operating condition shown in FIG. 9 is displayed. If the answer is NO, the flow moves to the next step C50 in which whether general information (building information or the like) is to be displayed is determined, and in which predetermined conditions, for example, a condition in which a long waiting is detected, a condition of a predetermined time, and a condition in which the elevator has not been used for a predetermined time are provided to be determined (in a case where the display is always displayed, the answer is always YES). In step C50, if the answer is YES, the flow moves to step C60 in which general information is displayed. If the answer is NO, no display is displayed. In step C70, all of the floors are loop-processed.

In this embodiment, the following benefits can be obtained.

(i) Since the operating condition of the elevator has a displaying priority over general information if a predetermined condition of the operating information on the elevator is met, a display which is suitable for the waiting passengers' mental states can be obtained so that they do not get irritated.

(ii) Since one display device in a hall displays both operating information on the elevator and general information, the waiting passengers need to look at only one display device and thus they are less mentally burdened.

(iii) Since the number of display devices in a hall does not need to be increased, costs can be kept low.

Next, a variation of this embodiment will be described.

In the above described embodiments, operating information is displayed on the display device of an elevator which satisfies a predetermined condition. On the other hand, the display devices of the other elevators display general information (or no display). In this variation, when an assigned elevator called from a hall arrives or is about to arrive, the displays of the elevators which are not assigned show more specific operating information that the assigned car is about to arrive.

Figure 12:
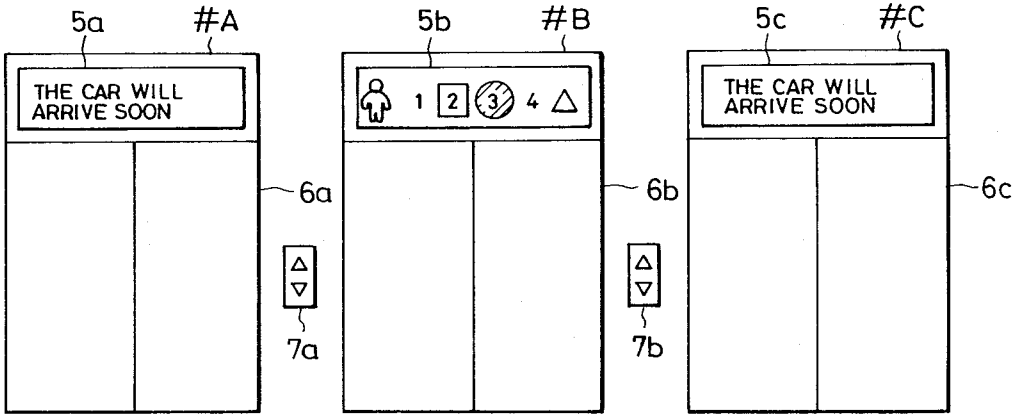
FIG. 12 shows an example of variation of display pattern according the other embodiment.

FIG. 12 illustrates an example in which operating information such as the position of the car, direction of travel, floors where the car is to stop, relevant floor mark, number of passengers in the car, and so forth is displayed in a routine form by the display device of the assigned elevator, while more specific operating information is displayed by the display device of the non-assigned elevators.

Referring to FIG. 12, when the assigned elevator arrives at the second floor, the displays 5*a* and 5*c* of the elevators #A and #C display, as shown in FIG. 4, a message "the car will arrive soon" for the purpose of informing waiting passengers that the assigned car is to arrive soon, thus allowing the waiting passengers to prepare for boarding. Another example of a message that can be employed: "The car is departing the second floor, please wait at the elevator whose arrival light is on" for the purpose of informing waiting passangers that the assigned car is to arrive soon. If the message is too long, the message can be displayed in a scroll manner.

With the present variation of the invention, the display devices display both elevator operating information and general information. Even when the waiting passengers are looking at the general information, a display showing that the car is arriving or is about to arrive is displayed by the displays of the non-assigned elevator when a car arrives or is about to arrive. Thus, the waiting passengers can prepare for boarding, and tardiness in boarding can be prevented.

As described above, according to the present invention, the present states of elevators can be informed to waiting passengers, and consequently they can be guided smoothly without causing any confusion or making them impatient or distrustful.

What is claimed is:

1. An information device of an elevator which serves a plurality of floors comprising:

service information devices which are disposed at each boarding place; evaluation value arithmetic means for obtaining an evaluation value from the state of said elevator;

means for judging at least said evaluation value, and determining a type of display pattern of said service information device; and processing means for generating picture data of said service information device in accordance with information showing said state of said elevator and said determined type of display pattern.

2. An information device of an elevator according to claim 1, wherein said display pattern comprises means for expressing information items indicating at least the number of passengers in the car and the waiting time before arrival of said elevator, using pictures and characters.

3. An information device of an elevator according to claim 1, wherein said evaluation value includes a quantity relating to the time until said elevator arrives.

4. An information device of an elevator according to claim 1, wherein said evaluation value includes quantities relating to the position and direction of motion of said elevator.

5. An information device of an elevator which serves a plurality of floors comprising:

service information devices which are disposed at each boarding place;

evaluation value arithmetic means for obtaining an evaluation value from the state of said elevator;

means for deciding whether at least said evaluation value satisfies predetermined conditions, and deciding whether elevator operating information or general information other than said elevator operating information is to be displayed as a display pattern on said service information device; and means for generating picture data of said information device by making use of said information on the state of said elevator and the determined type of said display pattern.

6. An information device of an elevator according to claim 5, wherein said predetermined conditions are at least one of conditions in which automatic operation is detected, in which controlled operation is detected, in which a hall call at a relevant floor is detected, in which the car is detected at a location within a predetermined number of floors of and upstream of the floor at which said hall call was made, and in which the waiting time in a hall is within a predetermined time.

7. An elevator information device according to claim 5, wherein said means for deciding whether said elevator operating information or said general information other than said elevator operating information is to be displayed is arranged to causes said service information devices of non-assigned elevators to display the fact that an assigned elevator is to arrive when said assigned elevator arrives or is about to arrive.

* * * * *